US005426492A

United States Patent [19]

Diehl

[11] Patent Number: 5,426,492

[45] Date of Patent: Jun. 20, 1995

[54] SPACE OPTIMIZING TONER CARTRIDGE

[75] Inventor: Michael J. Diehl, Rochester, N.Y.

[73] Assignee: Xerox Corporation, Stamford, Conn.

[21] Appl. No.: 225,674

[22] Filed: Apr. 11, 1994

[51] Int. Cl.[6] ..... G03G 15/06

[52] U.S. Cl. ..... 355/260; 355/245; 222/DIG. 1

[58] Field of Search ..... 355/245, 260; 222/DIG. 1, 95, 388.5

[56] References Cited

U.S. PATENT DOCUMENTS

| | | | |
|---|---|---|---|
| 3,385,500 | 5/1968 | Lavender | 229/7 |
| 4,353,637 | 10/1982 | Parker | 355/260 |
| 4,397,546 | 8/1983 | Burdette | 355/245 |
| 4,417,802 | 11/1983 | Forbes, II | 355/260 |
| 4,583,842 | 4/1986 | Shimono et al. | 355/260 |
| 4,603,714 | 8/1986 | Marotta | 141/383 |
| 4,766,457 | 8/1988 | Barker et al. | 355/260 |
| 4,827,307 | 5/1989 | Zoltner | 355/260 |
| 4,920,381 | 4/1990 | Mahoney | 355/260 |
| 4,931,837 | 6/1990 | Abuyama et al. | 355/260 |
| 4,931,838 | 6/1990 | Ban et al. | 355/260 |
| 4,937,628 | 6/1990 | Cipolla et al. | 355/260 |
| 5,075,727 | 12/1991 | Nakatomi | 355/260 |
| 5,079,591 | 1/1992 | Tomita et al. | 355/260 |
| 5,083,166 | 1/1992 | Hill et al. | 355/260 |
| 5,148,223 | 9/1992 | Cipolla | 355/260 |

FOREIGN PATENT DOCUMENTS

| | | | |
|---|---|---|---|
| 0294469 | 12/1986 | Japan | 355/260 |
| 0089078 | 4/1987 | Japan | 355/260 |
| 0210867 | 9/1988 | Japan | 355/260 |
| 0063080 | 3/1990 | Japan | 355/260 |

*Primary Examiner*—Matthew S. Smith
*Attorney, Agent, or Firm*—Kevin R. Kepner

[57] ABSTRACT

A space optimizing toner container for an electrophotographic printing machine. The toner container is generally configured so that it is larger in the horizontal dimension than in the vertical dimension. A pusher member, internal to the container housing is spaced from the discharge opening in the housing. The pusher member is movable, either manually or by a biasing device such as a spring so that the powder toner is moved in a generally horizontal direction as the toner is depleted. The container may have a flexible inner liner which contains the toner particles and allows for the recycling of the container. The described toner container operates without the need for a complex toner transport system while allowing the normally unused space in the horizontal direction from the toner outlet to be utilized.

14 Claims, 3 Drawing Sheets

FIG. 1
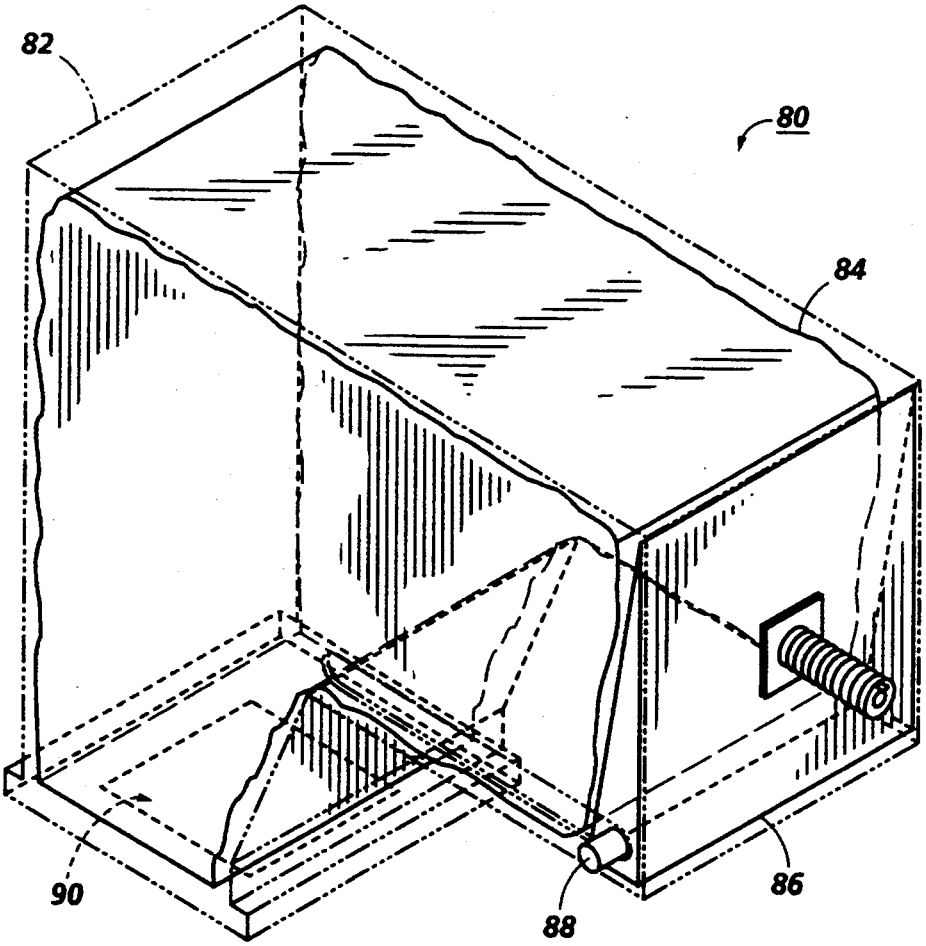
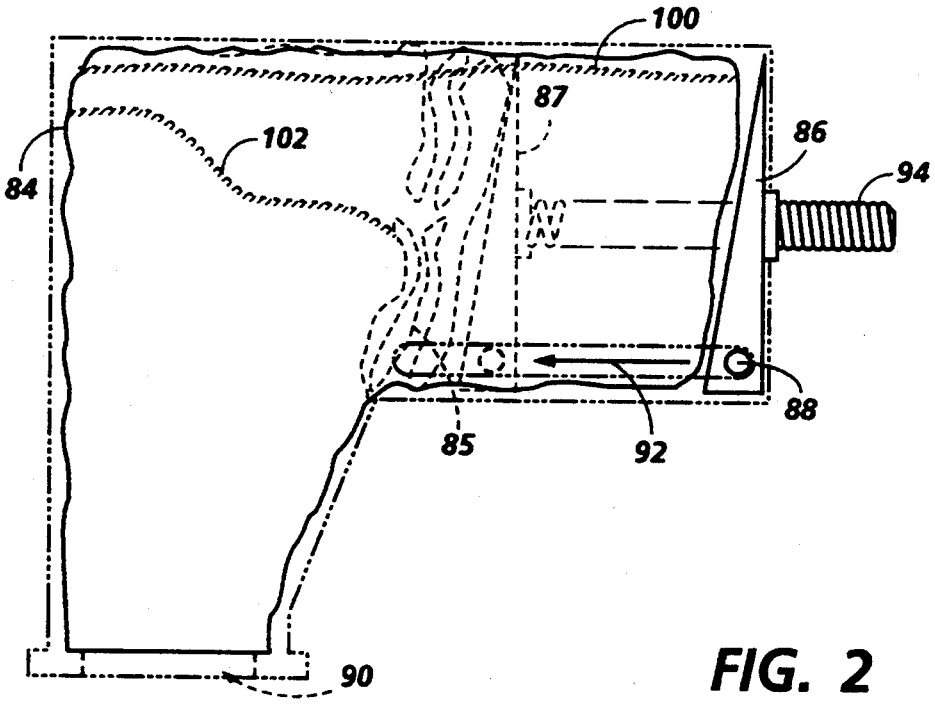
FIG. 2

FIG. 3
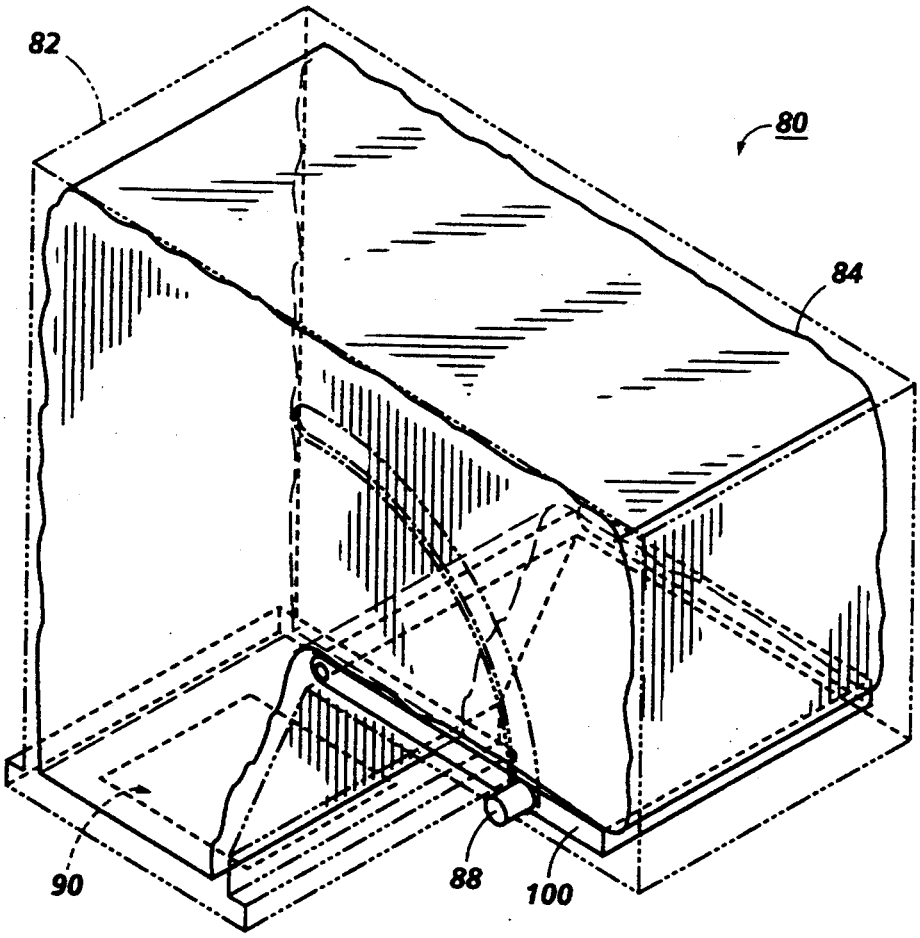
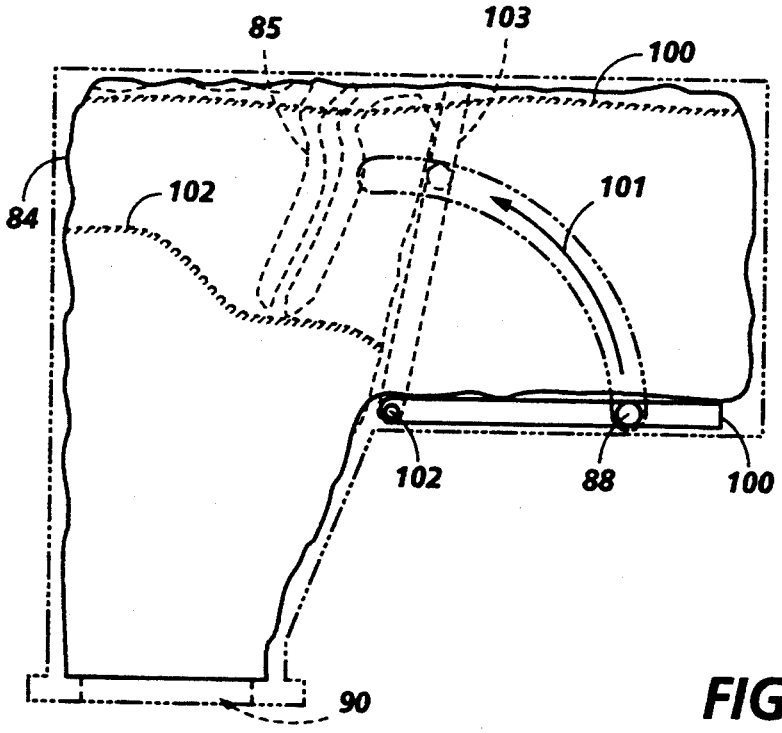
FIG. 4

SPACE OPTIMIZING TONER CARTRIDGE

This invention relates generally to a toner cartridge, and more particularly concerns a space optimizing toner cartridge having a simple device for discharging the toner therefrom.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In many of the machines described above, powder toner is contained in a removable container which mates with the developer housing to supply toner to the developer housing for mixing with the carrier. Typically, the toner container is some sort of cartridge which allows the toner to feed into the developer housing due to the force of gravity. This gravitational force necessitates that the containers be configured vertically to the developer housing inlet to allow the toner to fall into the housing. Some other more complex systems utilize an auger or endless belt type transport to move the toner in a horizontal direction from the container to the developer housing inlet.

It is desirous to have a toner container that can utilize space in the direction horizontal to the developer housing inlet without necessitating a complex toner transport system. It is also desirous that the toner container be easily replaceable and be suitable for recycling or disposal without a negative environmental impact.

The following disclosures may be relevant to various aspects of the present invention:

U.S. Pat. No. 4,937,628 Inventor Cipolla et al. Issue Date: Jun. 26, 1990

U.S. Pat. No. 4,827,307 Inventor: Zoltner Issue Date: May 2, 1989

U.S. Pat. No. 4,603,714 Inventor: Marotta Issue Date: Aug. 5, 1986

U.S. Pat. No. 4,417,802 Inventor: Forbes II Issue Date: Nov. 29, 1983

U.S. Pat. No. 4,397,546 Inventor: Burdette Issue Date: Aug. 9, 1983

U.S. Pat. No. 4,353,637 Inventor: Parker Issue Date: Oct. 12, 1982

U.S. Pat. No. 3,385,500 Inventor: Lavander Issue Date: May 28, 1968

The relevant portions of the foregoing disclosures may be briefly summarized as follows:

U.S. Pat. No. 4,937,628 discloses an apparatus for storing and dispensing particulate material comprising a container defining a chamber for storing particulate material, having an opening in the surface which may be closed and sealed. The opening has a frame member attached to the container closing the opening, which is two spaced parallel rails on each side of the opening and a movable door member larger than the opening with two parallel tracks spaced to enable them to slide in the rails to move the door between an open and a closed position. The door has a seal material around the periphery to prevent leakage of the particulate matter.

U.S. Pat. No. 4,827,307 describes a toner cartridge for use in a copying machine for supplying fresh toner to the developer of the machine. The cartridge is formed with an elongated opening to permit discharge of toner when inverted. A removable flexible strip covers the opening and is detachably held to the cartridge by adhesive material. The pattern of adhesive material is nonlinear at the portions of the cartridge adjacent the ends of the opening so that an application of a pulling force upon the strip to detach the same, the resistance force is gradual.

U.S. Pat. No. 4,603,714 discloses a toner bottle for resupplying toner to a copying or reproduction machine having an iris-type closure in the bottle mouth to control discharge of toner therefrom and prevent spilling. The iris-type closure consists of a first iris member located in the bottle mouth with the second cooperating iris closure integral with the cover for the bottle, projecting tabs on the first and second iris members cooperate with the machine toner hopper to establish relative rotation between the first and second iris members on rotation of the bottle while locking the bottle in place on the machine.

U.S. Pat. No. 4,417,802 describes an apparatus which dispenses toner particles into a chamber of a housing storing developer material. The toner particles are stored in the container and dispensed form the uppermost portion thereof by means of a toner conveyer.

U.S. Pat. No. 4,397,546 discloses an apparatus which discharges particles into the chamber of a housing storing a supply of developer material therein. Particles are dispensed from a storage container substantially uniformly to a region located therebeneath in the chamber of the housing and to a region displaced therefrom utilizing an auger transport mechanism.

U.S. Pat. No. 4,353,637 discloses a developer chamber which moves toward a developing member to moves the developer material to the latent image. As developer material is depleted, the housing moves automatically toward the developing member to furnish a continuous supply of developer material.

U.S. Pat. No. 3,385,500 describes a toner container having a flexible plastic liner.

In accordance with one aspect of the present invention, there is provided a space optimizing toner cartridge, adapted to mate with and supply toner to a housing defining a chamber having a device for developing a latent image with toner disposed at least partially therein. The container comprises a main body defining a chamber adapted to store toner therein being coupled directly to the housing chamber and a member disposed within the chamber of said main body, said member being adapted to move toner from the chamber of said main body into the housing chamber.

Pursuant to another aspect of the present invention, there is provided an electrophotographic printing machine having a replaceable space optimizing toner cartridge, adapted to mate with and supply toner to a housing defining a chamber having a device for developing a latent image with toner disposed at least partially therein. The cartridge comprises a main body defining a chamber adapted to store toner therein being coupled directly to the housing chamber and a member disposed within the chamber of said main body, said member being adapted to move toner from the chamber of said main body into the housing chamber.

Other features of the present invention will become apparent as the following description proceeds and upon reference to the drawings, in which:

FIG. 1 is a perspective view of a first embodiment of the toner container utilizing the invention herein;

FIG. 2 is an elevational view of the FIG. 1 container;

FIG. 3 is a perspective view of a second embodiment of the toner container utilizing the invention herein;

FIG. 4 is an elevational view of the FIG. 3 container; and

Figure 5:
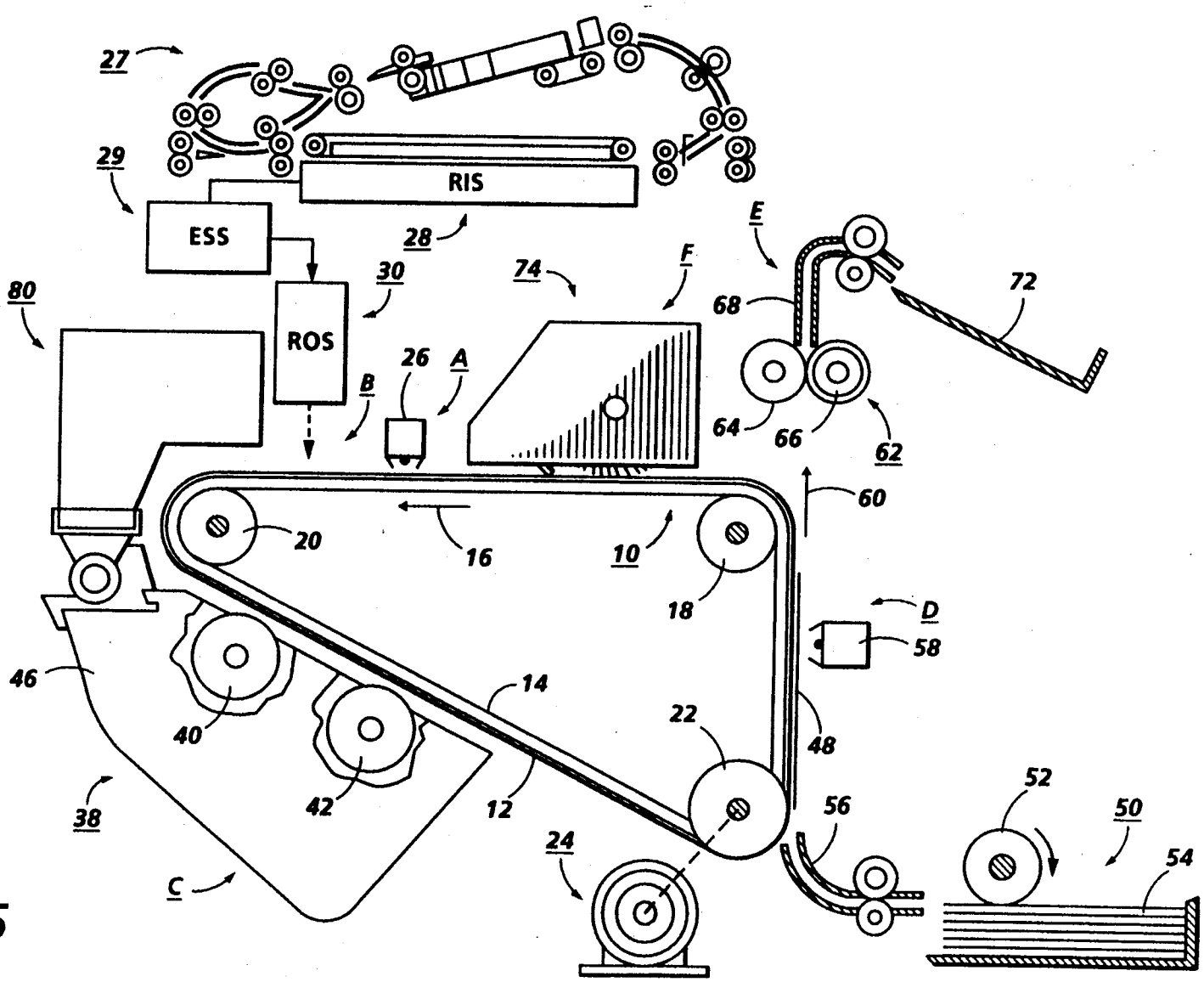
FIG. 5 is a schematic elevational view of an electrophotographic printing machine including the toner container of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 5 schematically depicts an electrophotographic printing machine incorporating the features of the present invention therein. It will become evident from the following discussion that the toner container of the present invention may be employed in a wide variety of devices and is not specifically limited in its application to the particular embodiment depicted herein.

Referring to FIG. 5 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

The Figure printing machine employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS, will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 20 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. Development station C contains the space optimizing toner cartridge described in detail below. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. The toner particle dispenser, indicated generally by the reference numeral 80, dispenses toner particles into developer housing 46 of developer unit 38.

With continued reference to FIG. 5, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 again through one or more drive roll idler roll assembly 200 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Turning now to FIG. 1, there is illustrated a perspective view of a first embodiment of a toner container according to the present invention. The container 80 is a generally rectangular shaped box forming a chamber within to hold powder toner. The chamber has an opening at the bottom 90 which allows toner particles to fall due to gravitational forces from the chamber into the developer housing 46. A flexible inner liner 84 is illustrated to contain the toner particles within the boxlike structure 82 and prevent leakage thereof.

Turning also to FIG. 2, it is seen that there is a pusher member 86 located remote from the opening 90 in the toner container 80. Initially, when the toner container 80 is full, the powder toner will be at a level illustrated by the dotted line 100 within the chamber. The pusher member 86 is used to push the toner and the flexible member containing the toner in the direction toward the opening 90 as the toner is depleted. As illustrated, the pusher member 86 would move in the direction of arrow 92 until it reached the position illustrated in phantom as 87. The pusher member has a indicator 88 which is visible on the exterior of the toner housing 80.

As the toner is depleted by being fed into the developer housing 46 as illustrated by the dotted line 102, the pusher member 86 is moved in a horizontal direction either manually or by a biasing member illustrated as spring 94 in FIG. 2. This configuration allows the utilization of space which is normally unusable due to the inability to move the toner in a horizontal direction within the container. It also reduces the need to have the toner container be large in the vertical direction so that the toner may fall solely by means of gravity. The indicator 88 is useful in that it provides some indication of the state of usage of the toner. When it is in its initial position, the toner container is full and as it is moved in a horizontal direction to the end of its degree of travel, there is an indication that the toner hopper or container soon needs to be replaced.

The toner container itself may be made of a cardboard material with a flexible plastic inner liner 84 which provides for segregation of the toner contaminated liner 84 and the cardboard material when the container is empty thus enabling recycling of the materials used for the packaging. Alternatively, the toner container exterior housing 82 may be constructed of a material such as a polystyrene plastic which would then allow for removal of the flexible baglike liner, and replacement thereof with a full toner bag so that the toner housing 82 may be reused.

The biasing member or spring 94 may be either integral to the toner cartridge so that the pusher is automatically moved as the toner is used or the biasing member may be located within the machine and mated with the cartridge 80 as it is installed into the printing machine. In either case, as the toner is depleted as illustrated, from a full condition represented by line 100 to a near empty condition represented by line 102 in FIG. 2, the biasing member causes the pusher member 86 to move in a horizontal direction and push the toner toward the opening 90 in the bottom of the housing 82. Thus, a simple and uncomplicated mechanism is utilized to move the toner in a horizontal direction without the need for complicated drive motors such as that used with augers and/or toner transport belts or conveyors.

The pusher member 86 may also be manually operated. The operator may move the pusher by grasping the indicator 88 and moving it horizontally to push the toner within the container 80 toward the opening 90 to cause toner to be dispensed into the developer housing. The manual operation can be done in response to a low toner signal on a user interface of the printing machine.

Turning next to FIGS. 3 and 4, a second embodiment of the toner container is illustrated. In the second embodiment, the toner container 80 also is constructed of an outer housing 82 having a flexible inner liner 84 containing the powder toner. In this embodiment, a trapdoor-type hinged mechanism 100 is used to move the toner in a generally horizontal direction toward the opening 90 in the bottom of the container 82. The hinged pusher member 100 is movable in the direction generally indicated by arrow 101 so that it reaches the position indicated in phantom as 103. As the toner is depleted from a level that is illustrated by dotted line 100 to a level as illustrated by line 102 in FIG. 4, the pusher mechanism 100 is moved in the direction of arrow 101 either manually or by a biasing member. This causes the flexible liner 84 to fold upon itself as illustrated by phantom lines 85 and causes the toner to move in a generally horizontal direction toward the opening 90 in the bottom of the container 82, where it will fall into the developer housing. In either embodiment a mild adhesive may be utilized to attach the liner 84 to the interior of the container 82 to prevent the flexible liner 84 from collapsing and blocking the toner from being dispensed from the container 82.

The pusher member 100 also has an indicator 88 mounted thereto which is visible on the exterior of the container 82. This indicator can either be a mere level indicator when used with a self-biasing member or, it can serve as a handle for manual movement of the pusher member 100 to cause toner to move toward the opening 90 as described above with reference to the first embodiment. If a biasing member is used, the biasing member can either be integral to the container 80 or it can be mounted within the printing machine itself and moved into a cooperating position with the pusher member 100 as the cartridge is loaded into the printing machine. If the biasing member is integral to the toner cartridge 80, it is anticipated that a torsional type spring could be used to apply the biasing force to the pushing member 100 to apply a steady pivoting force to the pusher 100 to cause the toner to move toward opening 90. If the biasing member is not integral to the container 80, a biased lever type arrangement can be used to apply the pivoting force to the pusher member.

In recapitulation, there is provided a space optimizing toner container for an electrophotographic printing machine. The toner container is generally configured so that it is larger in the horizontal dimension than in the vertical dimension. A pusher member, internal to the container housing is spaced from the discharge opening in the housing. The pusher member is movable, either manually or by a biasing device such as a spring so that the powder toner is moved in a generally horizontal direction as the toner is depleted. The container may have a flexible inner liner which contains the toner particles and allows for the recycling of the container. The described toner container operates without the need for a complex toner transport system while allowing the normally unused space in the horizontal direction from the toner outlet to be utilized.

It is, therefore, apparent that there has been provided in accordance with the present invention, a toner container that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A space optimizing toner cartridge, adapted to mate with and supply toner to a housing defining a chamber having a device for developing a latent image with toner disposed at least partially therein, comprising:

a main body defining a chamber adapted to store toner therein being coupled directly to the chamber of said housing;

a member disposed within the chamber of said main body; and means for resiliently urging said member to move toner from the chamber of said main body into the chamber of said housing.

2. A cartridge according to claim 1, further comprising a flexible container having toner stored therein, said flexible container being located in the chamber of said main body.

3. A space optimizing toner cartridge, adapted to mate with and supply toner to a housing defining a chamber having a device for developing a latent image with toner disposed at least partially therein, comprising:

a main body defining a chamber adapted to store toner therein being coupled directly to the chamber of said housing; and a pusher member disposed within the chamber of said main body, said pusher member being adapted to move toner from the chamber of said main body into the chamber of said housing said pusher member comprises a biasing member disposed in the chamber of said main body, and a plate moveably supported within the chamber of said main body, said biasing member being attached to said plate to move said plate in a direction to advance toner from the chamber of said main body to the housing chamber.

4. A cartridge according to claim 3, wherein said plate is slidably mounted in the chamber of said main body.

5. A cartridge according to claim 3, wherein said plate is pivotably mounted in the chamber of said main body.

6. A cartridge according to claim 3, further comprising an indicator attached to said pusher member for indicating the level of toner in the chamber of said main body.

7. A cartridge according to claim 3, further comprising a flexible container having toner stored therein, said flexible container being located in the chamber of said main body.

8. An electrophotographic printing machine having a replaceable space optimizing toner space optimizing toner cartridge, adapted to mate with and supply toner to a housing defining a chamber having a device for developing a latent image with toner disposed at least partially therein, comprising:

a main body defining a chamber adapted to store toner therein being coupled directly to the chamber of said housing;

a biased pusher member disposed within the chamber of said main body; and means for resiliently urging said member to move toner from the chamber of said main body into the chamber of said housing.

9. A printing machine according to claim 8, further comprising a flexible container having toner stored therein, said flexible container being located in the chamber of said main body.

10. An electrophotographic printing machine having a replaceable space optimizing toner space optimizing toner cartridge, adapted to mate with and supply toner to a housing defining a chamber having a device for developing a latent image with toner disposed at least partially therein, comprising:

a main body defining a chamber adapted to store toner therein being coupled directly to the chamber of said housing; and a pusher member disposed within the chamber of said main body, said pusher member being adapted to move toner from the chamber of said main body into the chamber of said housing, wherein said pusher member comprises a biasing member disposed in the chamber of said main body, and a plate moveably supported within the chamber of said main body, said biasing member being attached to said plate to move said plate in a direction to advance toner from the chamber of said main body to the chamber of said housing.

11. A printing machine according to claim 10, wherein said plate is slidably mounted in the chamber of said main body.

12. A printing machine according to claim 10, wherein said plate is pivotably mounted in the chamber of said main body.

13. A printing machine according to claim 10, further comprising an indicator attached to said pusher member for indicating the level of toner in the chamber of said main body.

14. A printing machine according to claim 10, further comprising a flexible container having toner stored therein, said flexible container being located in the chamber of said main body.

* * * * *